US005263507A

United States Patent [19]

Chuang

[11] Patent Number: 5,263,507

[45] Date of Patent: Nov. 23, 1993

[54] COLLAPSIBLE TENT FRAME

[76] Inventor: Ching-Pao Chuang, No. 120-18, Yu Che, Yu Che Li, Ma Tou Chen, Tainan Hsien, Taiwan

[21] Appl. No.: 991,264

[22] Filed: Dec. 16, 1992

[51] Int. Cl.[5] ..... E04H 15/46

[52] U.S. Cl. ..... 135/107; 135/109; 135/112; 403/84; 403/97; 403/107

[58] Field of Search ..... 135/103, 106, 107, 108, 135/109, 112; 403/83, 84, 92, 93, 97, 98, 107

[56] References Cited

U.S. PATENT DOCUMENTS

| | | | |
|---|---|---|---|
| 1,633,820 | 6/1927 | Long et al. | 135/108 X |
| 4,111,217 | 9/1978 | Victor | 135/109 X |
| 4,365,908 | 12/1982 | Thiboutot | 135/109 X |
| 4,666,328 | 5/1987 | Ryu | 403/92 |
| 4,824,278 | 4/1989 | Chang | 403/93 |
| 4,905,946 | 3/1990 | Wang | 403/92 X |
| 5,069,238 | 12/1991 | Marks | 135/109 |
| 5,123,768 | 6/1992 | Franklin | 403/84 X |
| 5,167,246 | 12/1992 | Mortenson | 135/106 |

FOREIGN PATENT DOCUMENTS

| | | | |
|---|---|---|---|
| 2129464 | 5/1984 | United Kingdom | 135/103 |

*Primary Examiner*—Carl D. Friedman
*Assistant Examiner*—Lan M. Mai
*Attorney, Agent, or Firm*—Morton J. Rosenberg; David I. Klein

[57] ABSTRACT

A collapsible tent frame having two side frames connected with three lengthwise connecting tubes and four lengthwise locating tubes, each side frame consisting of two sloping-down top tubes connected with an angle-adjustable joint, two intermediate tubes connected with a one-direction adjustable joint to keep an upper tube sloping down and a lower tube upright and two leg tubes respectively connected with an upright tube of the intermediate tubes, which is connected with one of the sloping-down tubes, each leg tube having a caster to stand and move on the ground, the caster having a fixing pedal for securing it on something to keep it immovable.

2 Claims, 6 Drawing Sheets

COLLAPSIBLE TENT FRAME

BACKGROUND OF THE INVENTION

A conventional collapsible tent frame shown in FIG. 7, comprises two leg tubes 10, two sloping-down side tubes 20, two sloping-up side tubes 30, two ground plates 40 laid on the ground for supporting the two leg tubes 10, three lengthwise tubes 50 connected between the two sloping-down tubes 20, and a tent cloth 60.

Though this tent frame has a simple structure, it is evident to have stability not enough to keep itself from being fallen down in case of a little strong wind.

SUMMARY OF THE INVENTION

An object of this invention is to offer a collapsible tent frame having more stability to stand on the ground and convenience for assembling and disassembling.

A collapsible tent frame in the present invention comprises two side frames respectively consisting of two top sloping-down tubes connected with an angle-adjustable joint, two pairs of two intermediate tubes connected with a one-direction adjustable joint and having one tube sloping-down and the other upright, four leg tubes standing on the ground and respectively connected at its top with the upright tube of the intermediate tubes by means of a wing head thumb screw, three lengthwise tubes respectively connected between the two angle-adjustable joints and two pairs of two lengthwise locating tubes connected between two leg tubes of the side frames to help keep the whole tent frame secured.

BRIEF DESCRIPTION OF DRAWINGS

The invention will be better understood by reference to the accompanying drawings, wherein.

DETAILED DESCRIPTION OF THE INVENTION

Figure 1:
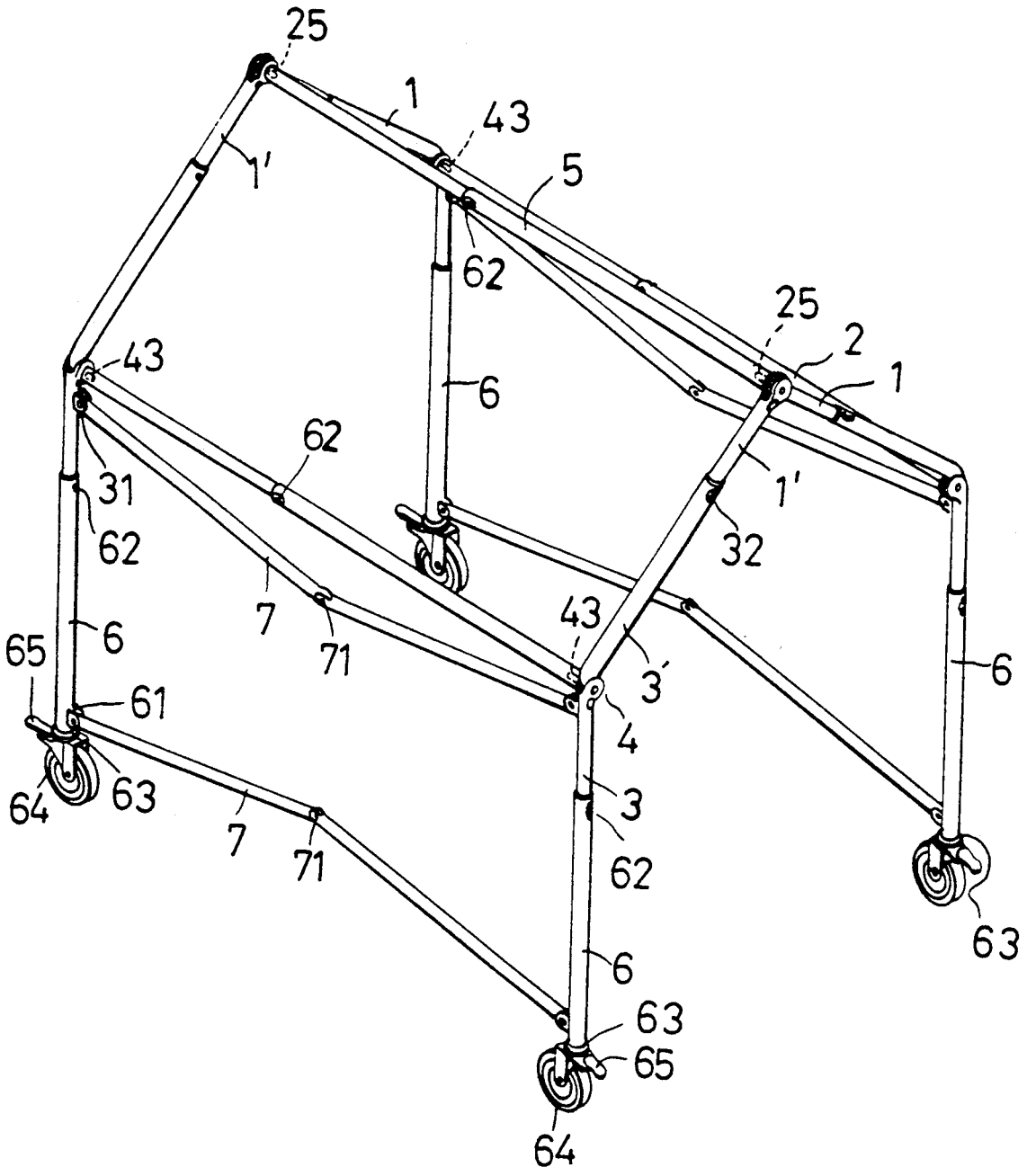
FIG. 1 is a perspective view of a collapsible tent frame in the present invention.
Figure 2:
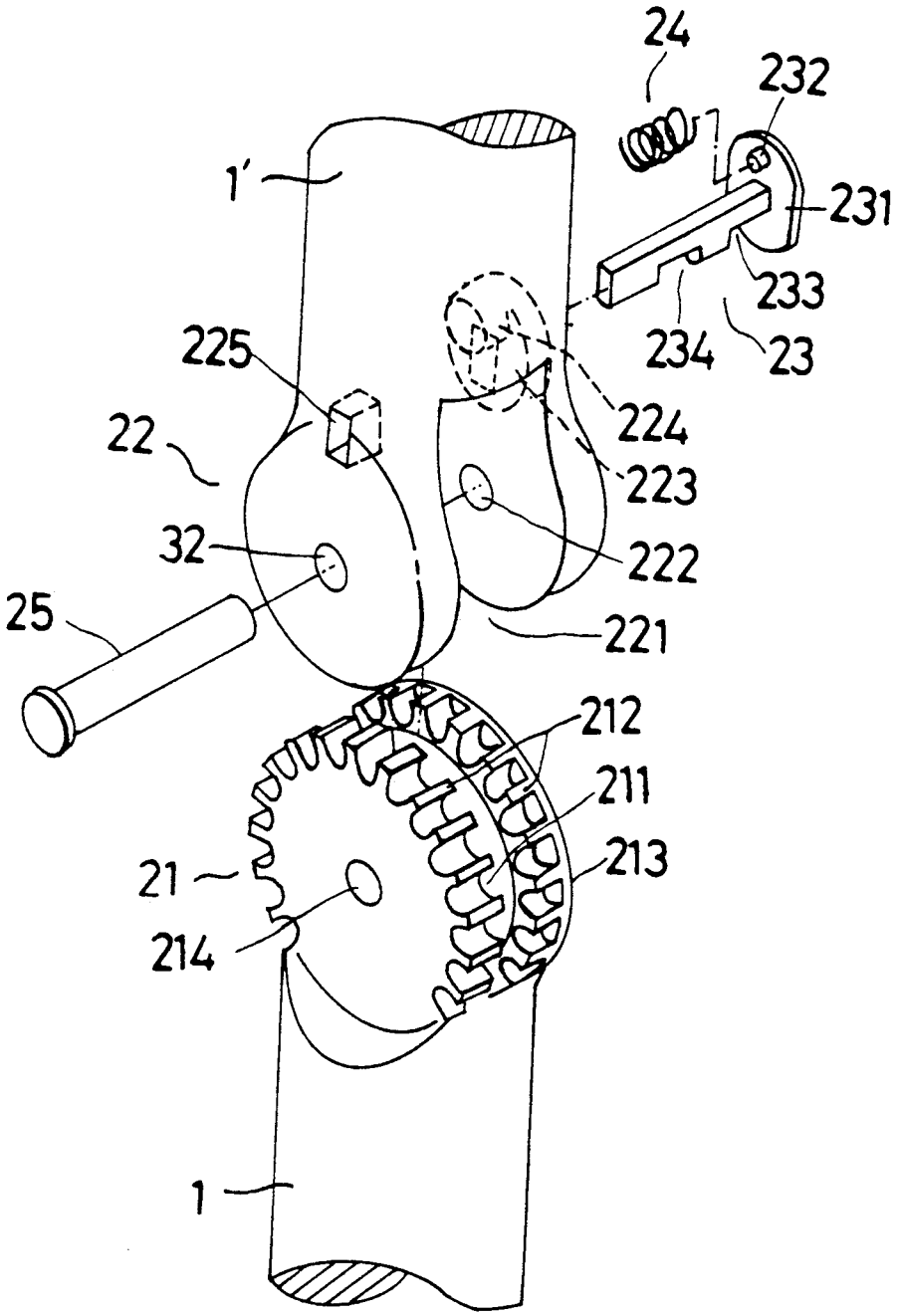
FIG. 2 is a cross-sectional view of an angle-adjustable joint in the present invention.
Figure 3:
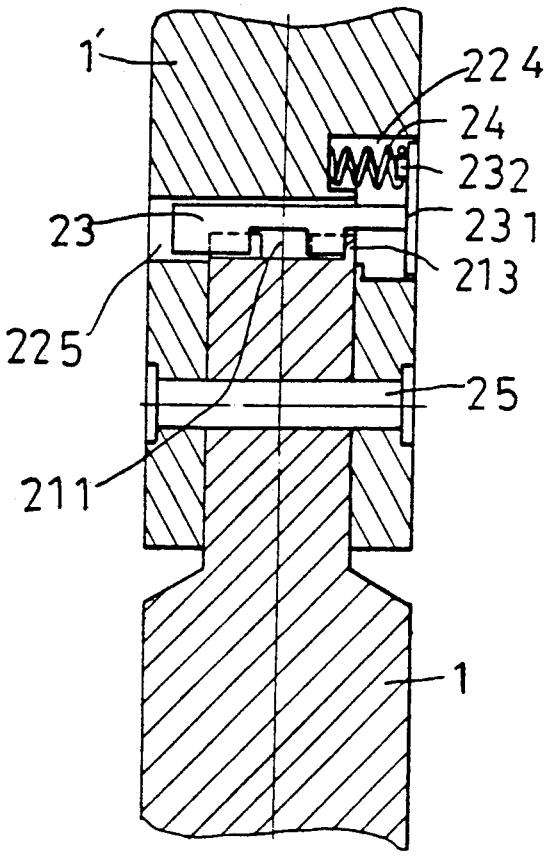
FIG. 3 is a side cross-sectional view of the angle-adjustable joint in the present invention.

A collapsible tent frame in the present invention, as shown in FIGS. 1, 2 and 3, comprises two side frames respectively consisting of two top tubes 1, 1' connected with an angle-adjustable joint 2, two pairs of two intermediate tubes 3, 3' connected with a one-direction adjustable joint 4, two leg tubes 6, 6, one lengthwise connecting tube 5 connected between the two angle-adjusting joint 2, 2 and two lengthwise connecting tubes 5, 5 respectively connected between the two one-direction adjusting joints 4, 4, and two pairs of two lengthwise locating tubes 7, 7 between the two leg tubes 6, 6.

The angle-adjustable joints 2, 2, respectively consist of a male joint 21, a female joint 22, and a locating member containing a push rod 23 with a push plate 231, a spring 24 and a pin 25. The male joint 21 has two sets of a plurality of grooves 211, and two sets of a plurality of locating teeth 212 between each two neighboring grooves 211 around nearly three quarters of an upper disc and a side wall 213 at the right side of two sets of the grooves 211 and the teeth 212, and a central hole 214 for a pin 25 to pass through. The male joint 21 has its lower end connected with one of the top tubes 1. The female joint 22 has one end formed as a round fork with an intermediate opening 221 for the toothed disc of the male joint 21 to fit therein, a lateral hole 222 for a pin 25 to pass through in a vertical side, a hole 223 in a vertical side for the push rod to pass through, a recess 224 in the bottom of the lateral hole 222 for a spring 24 to sit therein, a rectangular hole 225 in the other vertical side in line with the hole 223, and the other end connected with one of the top tubes 1. The push rod 23 has a push plate 231 fixed at one end, and a projection 232 on an inner wall of the push plate 231 for the spring 24 to fit around. The push rod 23 has a cross-section shaped as the rectangular hole 225 of the female joint 22, and two notches 233, 234 in a lower side to fit with a pair of locating teeth 212.

In combining, the spring 24 is placed around the projection 232 for the push plate 231, and the push rod 23 is pushed through the opening 223, through the opening 221 and then in the rectangular hole 225, letting the spring 24 fit in the recess 224. Then the push rod 23 is pressed most inward and the male joint 21 is inserted in the opening 221 of the female joint 22, letting the side wall 213 fit in the notch 233 of the push rod 23, which is then let loose. Next, the pin 25 is pushed through the holes 222, 214 in the female joint and the male joint 22, 21 to keep them in place. In a normal position, the push rod 23 is always placed in one set of locking teeth 212 to hold both the joints 21, 22 firmly in a certain adjusted angle, not to be altered by any means as shown in FIG. 3.

Figure 4:
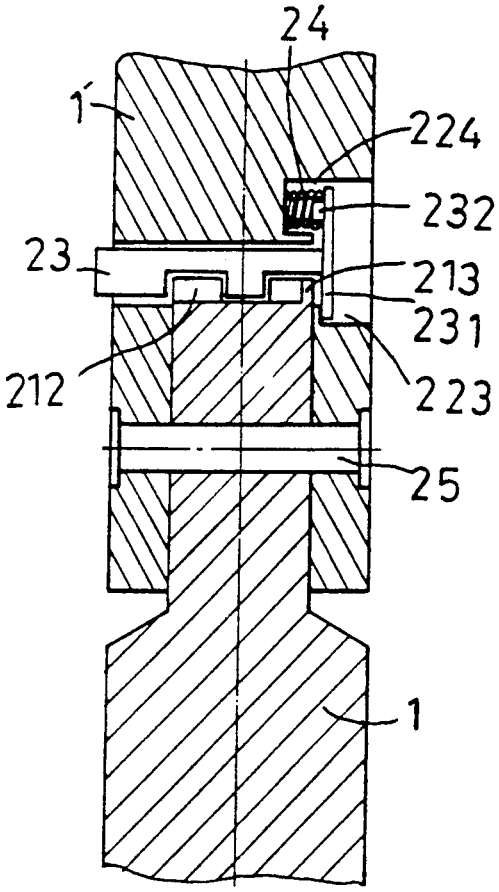
FIG. 4 is a side cross-sectional view of the angle-adjustable joint with its locating member pressed in the present invention.
Figure 5:
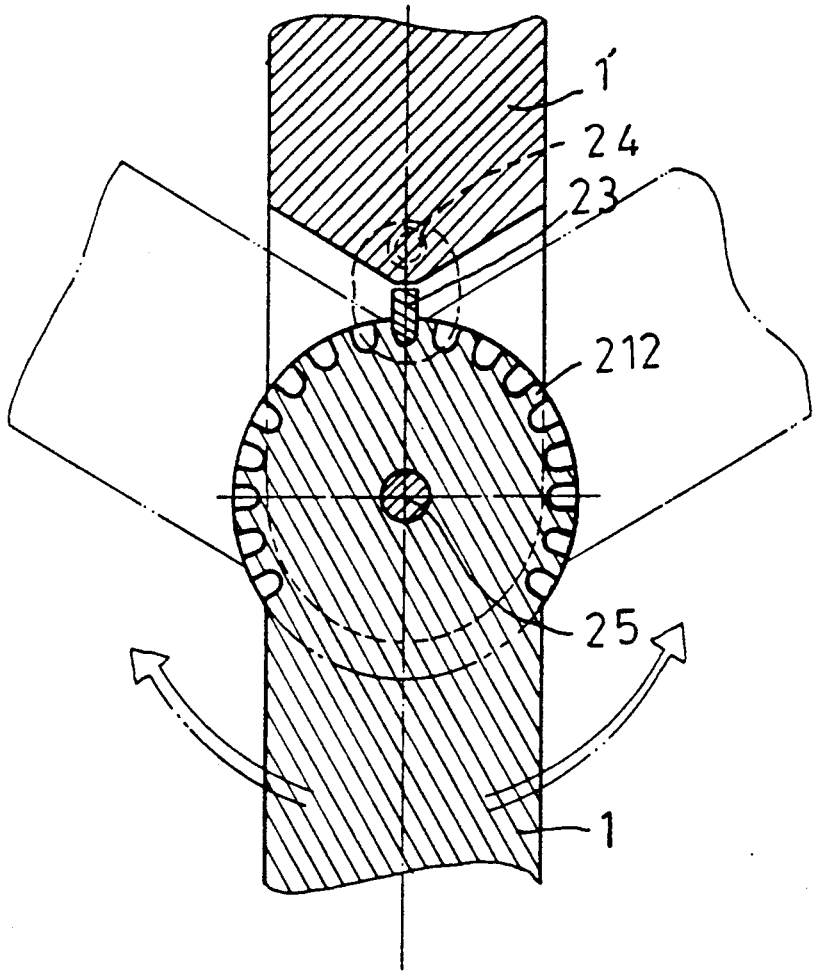
FIG. 5 is a cross-sectional view of the angle-adjustable joint in the present invention, showing how to bend it.
Figure 6:
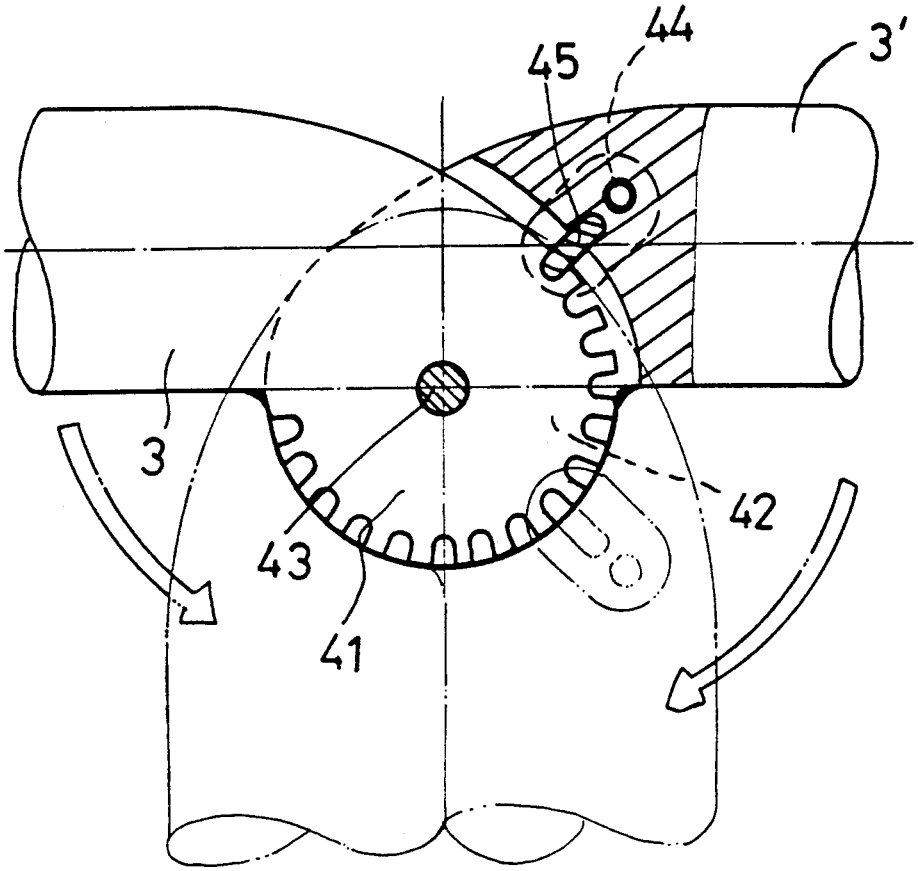
FIG. 6 is a cross-sectional view of a one-direction adjustable joint in the present invention, showing how to bend it; and, FIG. 7 is a perspective view of a conventional collapsible tent frame.
Figure 7:
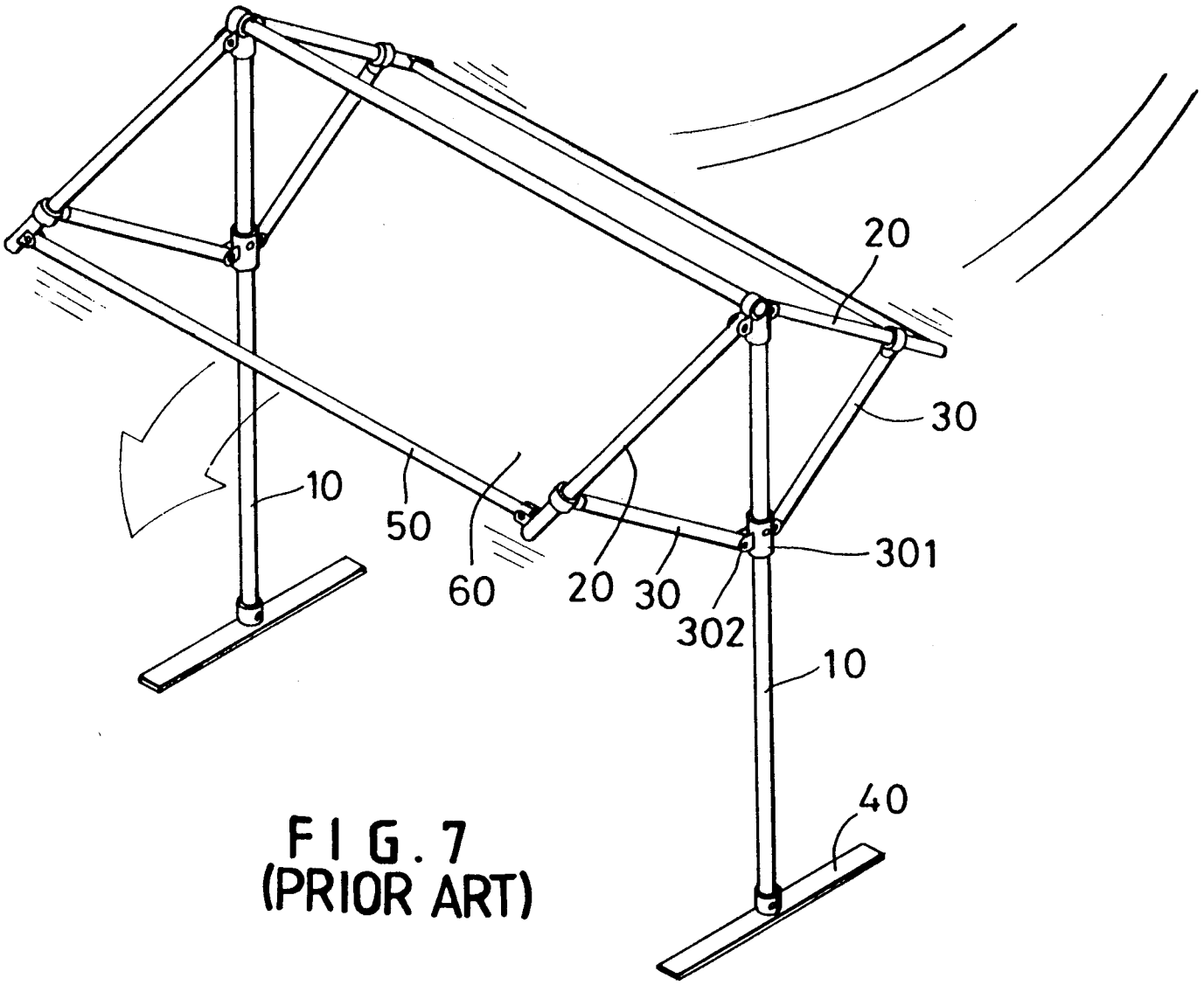
FIG. 7 (PRIOR ART)

If the push rod 23 is pushed most inward, the two notches 233, 234 thereof can move to lie just on a pair of the two set of locking teeth 212, separating from that pair of the locking teeth 212 as shown in FIGS. 4 and 5. Then the male joint 21, can be rotated to a needed angle to the female joint and then locked by releasing the push rod 23.

If the push rod 23 is released after pushed inward, it moves outward to let the joint 22 locked immovable as shown in FIG. 3.

The two intermediate tubes 3, 3' are connected with each other by means of the one-direction adjustable joint 4 consisting of a locating toothed disc 41 at one end of an intermediate tube 3 and two fork-shaped projections 42 formed at one end of the other intermediate tube 3, with an intermediate opening for the toothed disc 41 to fit therein and the both 41, 42 are kept in position by a pivotal pin 43. A stop key 45 pressed by a spring 44 are provided in the intermediate tube 3' to engage in one of grooves between each two teeth of the toothed disc 41 so that both tubes 3, 3' can be kept secured in a certain angle immovable. In case the key stop 45 is pressed to move inward to separate from the grooves of the disc 41, the tubes 3, 3' can be moved to an angle needed and locked at the position by releasing the key stop 45.

The pivotal pins 25, 43 used in the joints 2 and 4 fit in one end of the three lengthwise connecting tubes 5 provided to extend between two joints 2, 2 and 4, 4 to secure the rod 5 by means of their bias positions. The lengthwise connecting tubes 5 respectively consist of two portions joined together with a wing head thumb screw 62.

The intermediate tubes 3, 3' and the leg tubes 6 respectively have a sidewise projections 31, 61, and a locating tube 7 is placed to extend between two projections 31, 31 and 61, 61, having two protions pivotally connected with one another with a wing head thumb screw 71. The top tubes 1, 1' and the intermediate tubes 3, 3' are connected together with their length adjustable by means of the wind head thumb screw 32. The intermediate tubes 3, 3' and the leg tubes 6 are also connected together with their length adjustable by means of the wind head thumb screw 62.

The leg tubes 6 respectively have a foot plate 63 of rather large dimensions for keeping the whole tent frame in very secured position.

The foot plates 63 and be also combined with casters 64 for the whole tent frame to move around and fixing pedals 65 can also be provided with the foot plate 63 to keep the tent frame from moving.

A tent cloth 8 is adapted to cover on the tent frame constituted with the two side frames and the three lengthwise connecting tubes 5 and two pairs of two locating tubes 7.

While the preferred embodiments of the invention have been described above, it will be recognized and understood that various modifications may be made therein and the appended claims are intended to cover all such modifications which may fall within the spirit and scope of the invention.

What is claimed is:

1. A collapsible tent frame comprising;

two side frames each respectively consisting of two top tubes, two pairs of two intermediate tubes connected with the two top tubes, and two leg tubes standing on the ground and connected with the intermediate tubes;

said two top tubes connected with an angle-adjustable joint, sloping down to be connected with the intermediate tubes;

said two pairs of two intermediate tubes each respectively having an upper sloping-down tube connected with a lower upright tube by means of a one-direction adjustable joint and connected with one leg tube with a wing head thumb screw;

each said leg tube connected with the lower upright tube of the intermediate tubes so as to keep said tent frame standing on the ground;

three lengthwise connecting tubes respectively connected between two angle-adjusting joints and the two pairs of two one-direction adjustable joints, respectively consisting of two portions connected with a wing head thumb screw;

two pairs of two lengthwise locating tubes respectively connected between two leg tubes to secure the four leg tubes, consisting of two portions connected with a wing head thumb screw;

each said angle-adjusting joint consisting of a male joint, a female joint and a locating member;

said male joint having an end in a disc shape, and two sets of spaced-apart locking grooves located in parallel in said disc-shaped end, said locking grooves further including a plurality of teeth;

said female joint having a lateral hole, two projecting portions separated by an intermediate opening for mating engagement with said two sets of locking groove;

a pivotal pin passing laterally through both male and female joints to allow said male joint to rotate with respect to said female joint;

said locating member comprising a push rod having an outer end, and a push plate, said push plate is fixed to said outer end of said push rod; said push rod passing through said lateral hole in said female joint to disengageably connecting to said teeth of said male joint for rotating movement to adjust the position of said male joint with respect to said female joint.

2. The collapsible tent frame as claimed in claim 1, wherein each said leg tube has a foot plate at a lower end, a caster combined with the foot plate to move on the ground, and a fixing pedal provided on the caster to be secured on something to keep the whole tent frame immovable.

* * * * *